US009406423B1

(12) United States Patent
Tsai

(10) Patent No.: US 9,406,423 B1
(45) Date of Patent: Aug. 2, 2016

(54) MAGNETIC SLEEVE ASSEMBLY

(71) Applicant: Chung-Yu Tsai, Taichung (TW)

(72) Inventor: Chung-Yu Tsai, Taichung (TW)

( * ) Notice: Subject to any disclaimer, the term of this patent is extended or adjusted under 35 U.S.C. 154(b) by 0 days.

(21) Appl. No.: 14/944,246

(22) Filed: Nov. 18, 2015

(51) Int. Cl.

| | |
|---|---|
| ***B25B 23/12*** | (2006.01) |
| ***H01F 7/02*** | (2006.01) |
| ***B25B 23/02*** | (2006.01) |
| ***B25B 23/08*** | (2006.01) |
| ***B25B 13/06*** | (2006.01) |

(52) U.S. Cl.
CPC ..... *H01F 7/021* (2013.01); *B25B 13/06* (2013.01); *B25B 23/02* (2013.01); *B25B 23/08* (2013.01); *B25B 23/12* (2013.01)

(58) Field of Classification Search
CPC ..... B25B 23/02; B25B 23/08–23/12; B25B 13/06
USPC ..... 81/125, 438, 451
See application file for complete search history.

(56) References Cited

U.S. PATENT DOCUMENTS 7,107,882 B1 * 9/2006 Chang ..... B25B 23/12 81/125
9,314,909 B2 * 4/2016 Vaamonde Coton ... B25B 23/10
2007/0234856 A1 * 10/2007 Liu ..... B25B 15/001 81/438
2010/0269641 A1 * 10/2010 Chen ..... B25B 13/06 81/121.1
2013/0328276 A1 * 12/2013 Moss ..... B25B 23/0035 279/102
2015/0202751 A1 * 7/2015 Chen ..... B25B 23/0035 279/9.1
2015/0336246 A1 * 11/2015 Peters ..... B23B 31/107 81/439
2016/0039012 A1 * 2/2016 Hsu ..... B23B 31/1071 279/128

* cited by examiner

*Primary Examiner* — Ramon M Barrera

(57) ABSTRACT

A magnetic sleeve assembly includes a body, a sleeve, a magnetic member, and a C-clip. The body includes a function end and a first groove. The body extends through the sleeve. A first space is defined in the first end of the sleeve so as to receive the magnetic member. A second groove is defined in the outside of the sleeve. At least one through hole is defined in the inner end of the second groove and communicates with the first passage. The magnetic member has a second passage which communicates with the first passage. The C-clip is a flexible clip and engaged with the second groove of the sleeve. At least one engaging portion of the C-clip extends through the at least one through hole and is engaged with the first groove. The at least one engaging portion is movable between the first and second sidewalls.

9 Claims, 10 Drawing Sheets

A-A

B-B

C-C

A-A

MAGNETIC SLEEVE ASSEMBLY

BACKGROUND OF THE INVENTION

1. Fields of the Invention

The present invention relates to a magnetic sleeve assembly, and more particularly, to a magnetic sleeve assembly mounted to a screwdriver, and a C-clip is removably engaged with the sleeve. The sleeve and the C-clip are movable between two sidewalls of a groove in the screwdriver bit.

2. Descriptions of Related Art

The conventional magnetic sleeve assembly known to applicant is disclosed in U.S. Pat. No. 7,107,882 and comprises a screwdriver having a handle with a shank extending therefrom. The screwdriver has a tip at an end opposite the handle, and the shank has a fastening groove formed thereon adjacent the tip. The fastening groove defines narrow diameter on the shank and a shoulder adjacent the tip. A hollow sleeve has a fastening rim slidably positioned over the fastening groove of the shank. The shoulder abuts the fastening rim when the sleeve slides outwardly of the tip so as to retain the sleeve on the shank. The fastening rim extends inwardly at one end of the sleeve. A magnetic part is affixed to the opposite end of the sleeve. The magnetic part has an outer surface suitable for magnetically connecting to a screw head. The magnetic part has interior passageway, the tip of the screwdriver is slidable through the interior passageway as the fastening rim moves toward the shoulder.

However, because the inner diameter of the fastening rim is smaller than the diameter of the screwdriver, so that the screwdriver has to forcibly pushed to enlarge and then pass through the fastening rim and then reaches the fastening groove, and the fastening rim bounces backward to its original diameter. When the user wants to remove the screwdriver out from the sleeve, because the smaller inner diameter of the fastening rim, it is difficult to remove the screwdriver out from the sleeve, Furthermore, the sleeve has a smooth outer surface which makes the user difficult to firmly grasp the sleeve.

The present invention intends to provide a magnetic sleeve assembly to eliminate the shortcomings mentioned above.

SUMMARY OF THE INVENTION

The present invention relates to a magnetic sleeve assembly and comprises a body having a function end formed on the first end thereof, and a first groove is defined in the outside of the body and located close to the function end. The first groove has a first sidewall and a second sidewall. A sleeve has a first passage defined axially therethrough, and the body extends through the first passage, and the sleeve is rotatable relative to the body. A first space is defined in the first end of the sleeve and communicates with the first passage. The diameter of the first space is larger than that of the first passage. A second groove is defined in the outside of the sleeve and located close to the second end of the sleeve. At least one through hole is defined in the inner end of the second groove and communicates with the first passage. The at least one through hole is located between two third sidewalls which are located at the inner end of the second groove.

A magnetic member is a ring-shaped member and has a second passage defined axially therethrough. The magnetic member is received in the first space. The second passage communicates with the first passage. A C-clip is a flexible clip and engaged with the second groove of the sleeve. When the body extends through the sleeve, at least one engaging portion of the C-clip extends through the at least one through hole and is engaged with the first groove. The width of the at least one engaging portion is smaller than that of the first groove so that the at least one engaging portion is movable between the first and second sidewalls.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
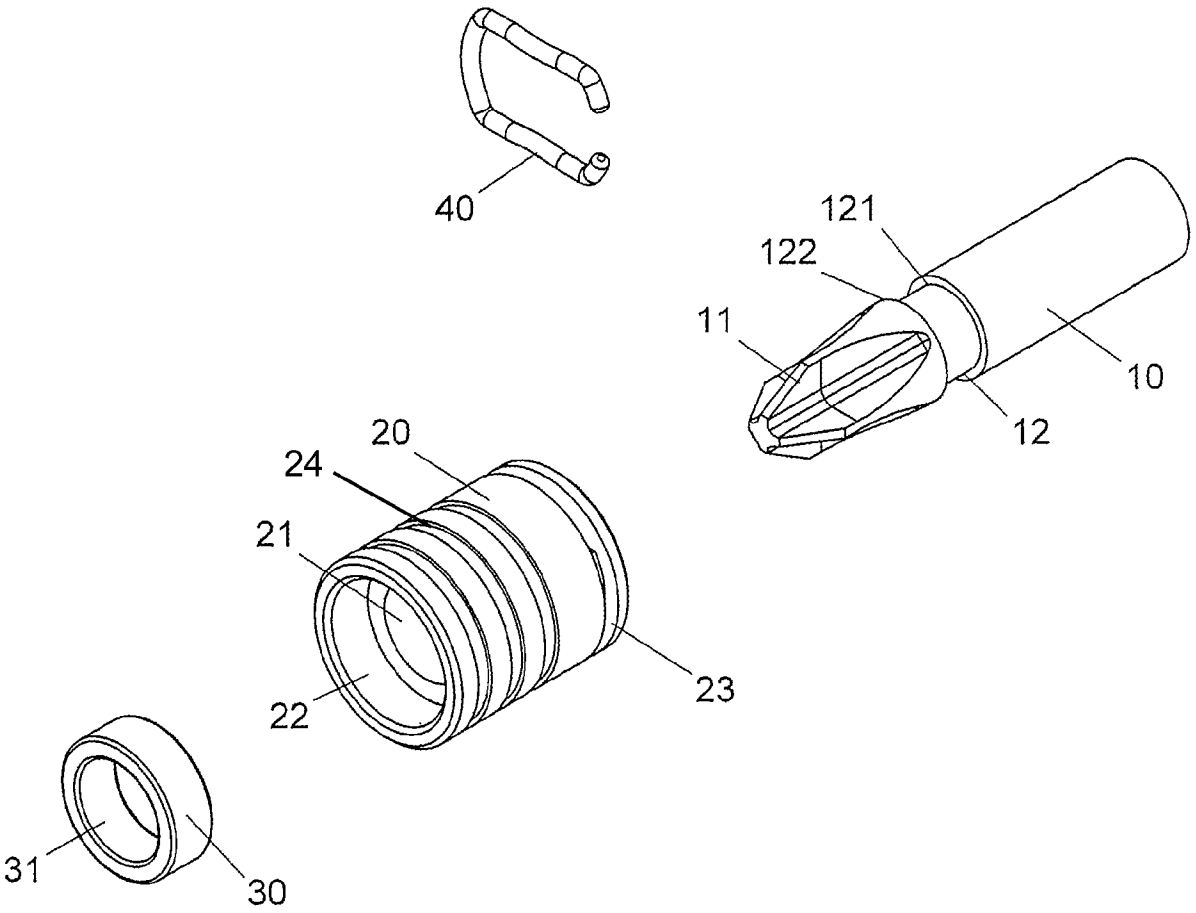
FIG. 1 is an exploded view of the magnetic sleeve assembly of the present invention.
Figure 4:
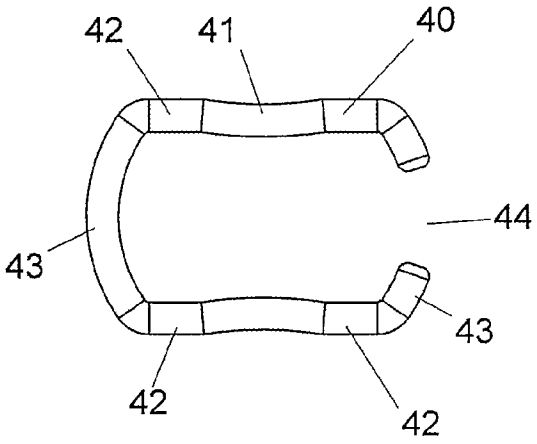
FIG. 4 is a side view of the C-clip of the magnetic sleeve assembly of the present invention.
Figure 3:
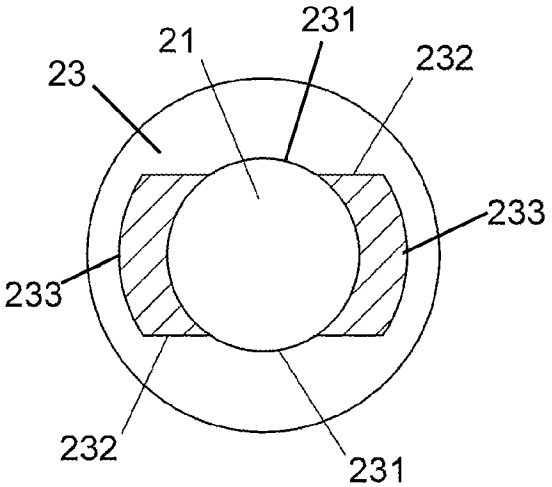
FIG. 3 is a cross sectional view, taken along line A-A in FIG. 2.
Figure 2:
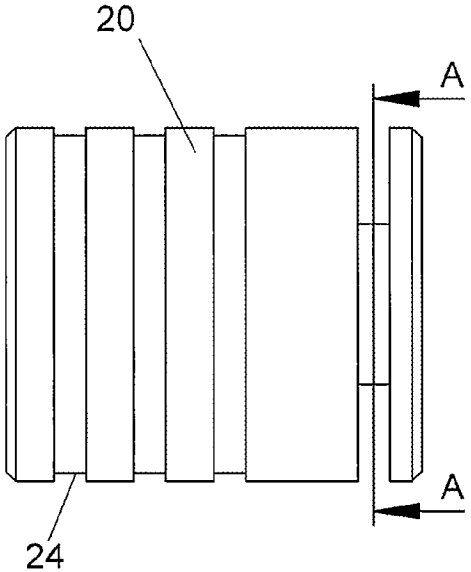
FIG. 2 is a side view of the sleeve of the magnetic sleeve assembly of the present invention.

Referring to FIGS. 1 to 4, the magnetic sleeve assembly of the present invention comprises a body 10, a sleeve 20, a magnetic member 30 and a C-clip 40. The body 10 is a screwdriver bit and has a function end 11 formed on the first end thereof. A first groove 12 is defined in the outside of the body 10 and located close to the function end 11. The first groove 12 has an inner end connected between a first sidewall 121 and a second sidewall 122. The sleeve 20 is a tubular member and has a first passage 21 defined axially therethrough. The body 10 extends through the first passage 21 and the sleeve 20 is rotatable relative to the body 10. A first space 22 is defined in the first end of the sleeve 20 and communicates with the first passage 21. The diameter of the first space 22 is larger than that of the first passage 21. A second groove 23 is defined in the outside of the sleeve 20 and located close to the second end of the sleeve 20. At least one through hole 231 defined in the inner end of the second groove 23 and communicates with the first passage 21. In this embodiment, there are two through holes 231 which are located at even distance in the inner end of the second groove 23. Each of the through holes 231 is located between two third sidewalls 232 which are located at the inner end of the second groove 23. The sidewalls 232 are parallel with the axis of the sleeve 20. The inner end of the second groove 23 has a first curved face 233 defined between each pair of the third sidewalls 232. The sleeve 20 has multiple annular recesses 24 defined in the outside thereof so that the user can easily grasp the sleeve 20.

The magnetic member 30 is a ring-shaped member and has a second passage 31 defined axially therethrough. The magnetic member 30 is received in the first space 22. The second passage 31 communicates with the first passage 21.

The C-clip 40 is a flexible clip and engaged with the second groove 23 of the sleeve 20. When the body 10 extends through the sleeve 20, two engaging portions 41 of the C-clip 40 extend through the through holes 231 and engage with the first groove 12. The width of each of the engaging portions 41 is smaller than that of the first groove 12 so that the engaging portions 41 are movable between the first and second sidewalls 121, 122. Each of the engaging portions 41 is connected between two contact portions 42 which contact the two third sidewalls 232. The C-clip 40 has two hooks 43 which are bent toward each other, the two hooks 43 contact the inner end of the second groove 23 and the first curved face 233. An opening 44 is formed between the two extensions of the C-clip 40.

Figure 5:
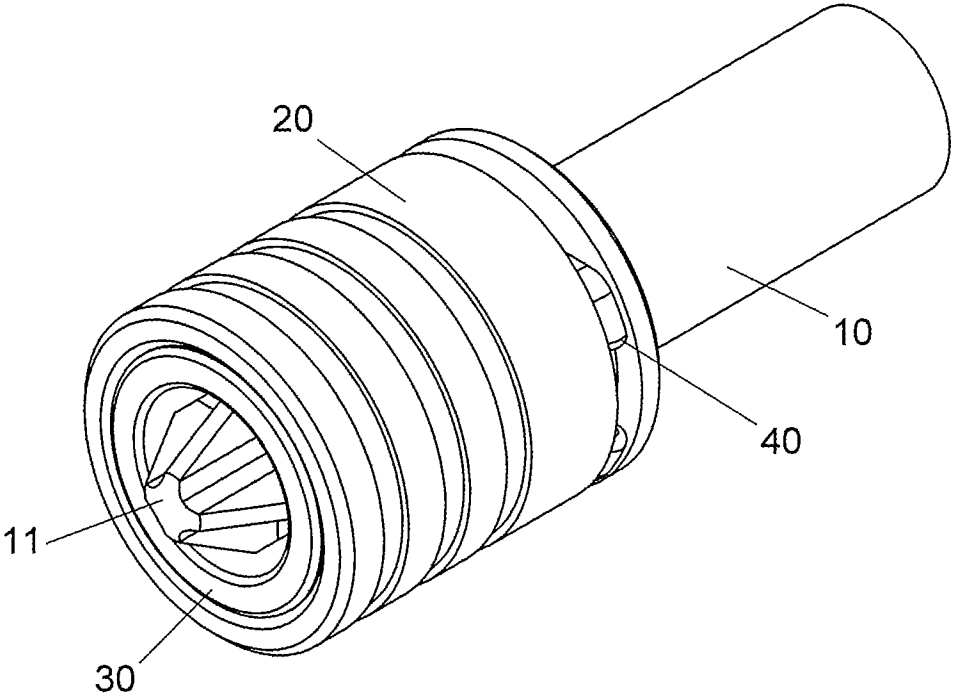
FIG. 5 is a perspective view to show the magnetic sleeve assembly of the present invention.
Figure 7:
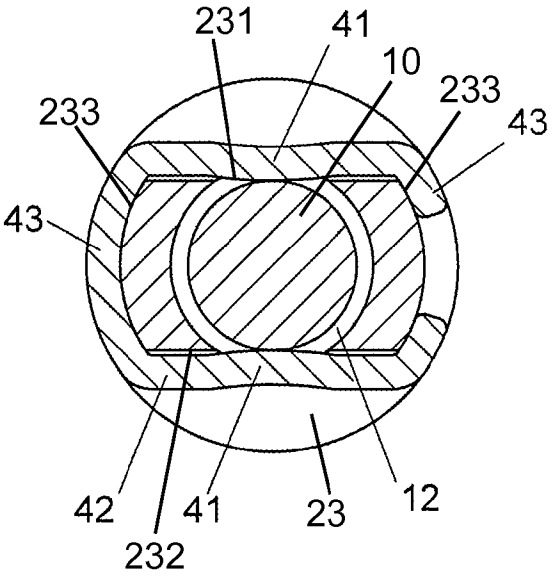
FIG. 7 is a cross sectional view, taken along line B-B in FIG. 6.
Figure 6:
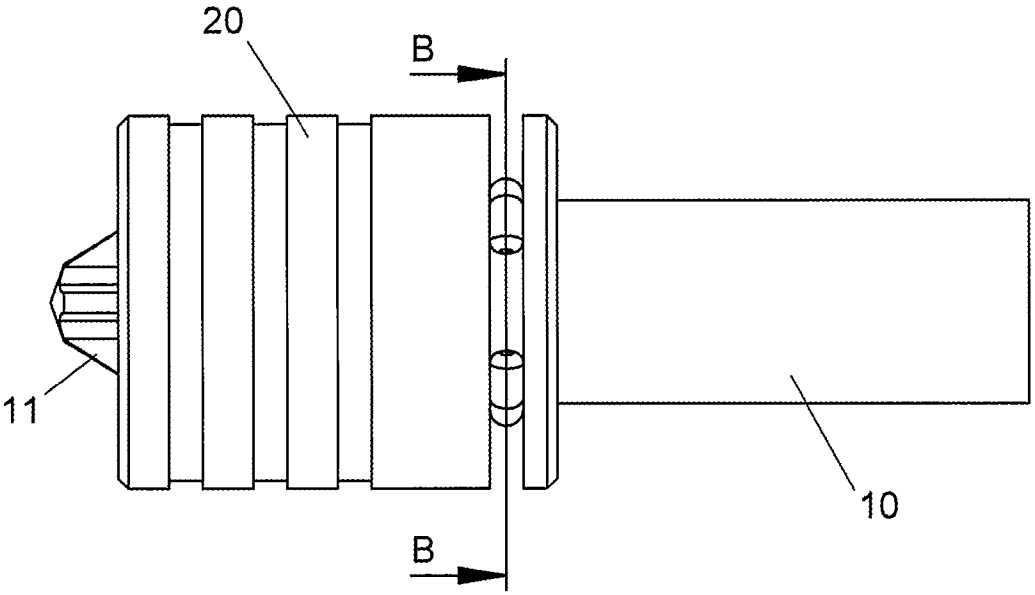
FIG. 6 is a side view to show the magnetic sleeve assembly of the present invention.

As shown in FIGS. 5 to 7, the magnetic member 30 is received in the first space 22, and the second space 31 is located in alignment with the first passage 21. The body 10 extends through the sleeve 20, and the second groove 23 is located corresponding to the first groove 12. The C-clip 40 is engaged with the second groove 23 from the outside of the sleeve 20. The engaging portions 41 extend through the through holes 231 and are engaged with the first groove 12. The function end 11 is rotatably received in the first passage 21. The distal end of the function end 11 protrudes beyond the magnetic member 30.

Figure 9:
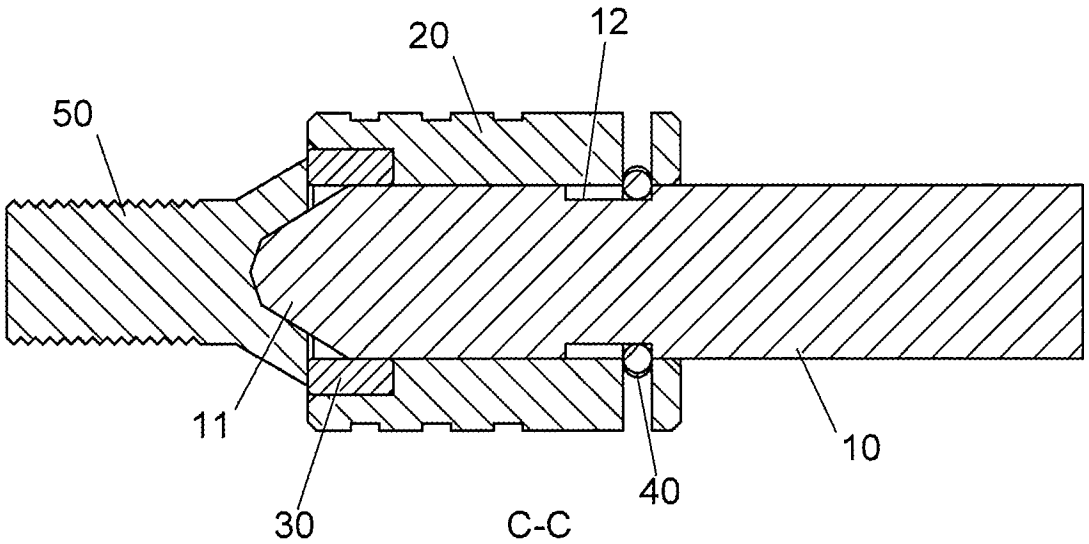
FIG. 9 is a cross sectional view, taken along line C-C in FIG. 8.
Figure 8:
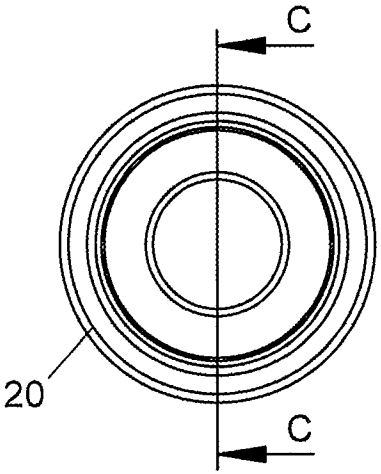
FIG. 8 is an end view of the magnetic sleeve assembly of the present invention.

As shown in FIGS. 8 and 9, the width of the first groove 12 allows the body 10 to move a pre-set distance relative to the sleeve 20. When the user wants to rotate an object 50 in a hole by the function end 11 of the body 10, the sleeve 20 is moved relative to the body 10 to let the C-clip 40 contact the first sidewall 121. The function end 11 is further extended beyond the magnetic member 30 which attracts the object 50 so that the function end 11 is not separated from the object 50.

Figure 10:
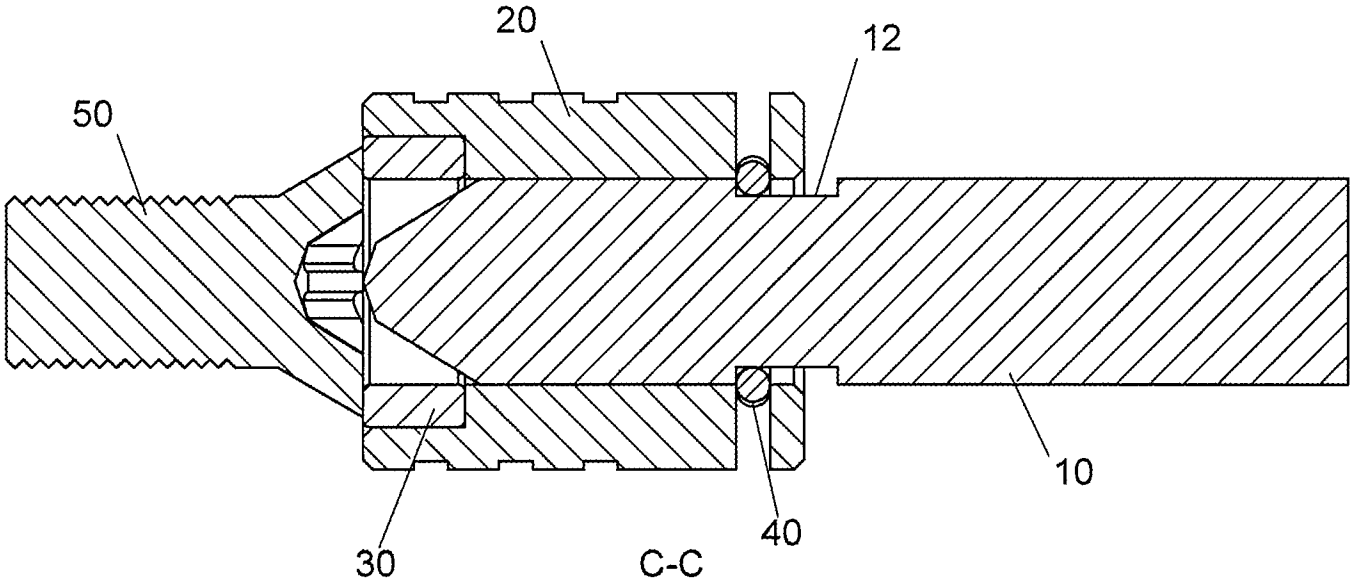
FIG. 10 is another cross sectional view, taken along line C-C in FIG. 8.

As shown in FIG. 10, when the user wants to detach the object 50, the sleeve 20 is moved to let to let the C-clip 40 contact the second sidewall 122. The function end 11 is in flush with the magnetic member 30 so that the function end 11 is separated from the object 50 which is still attracted to the magnetic member 30. The user can easily remove the object 50 from the magnetic member 30.

Figure 11:
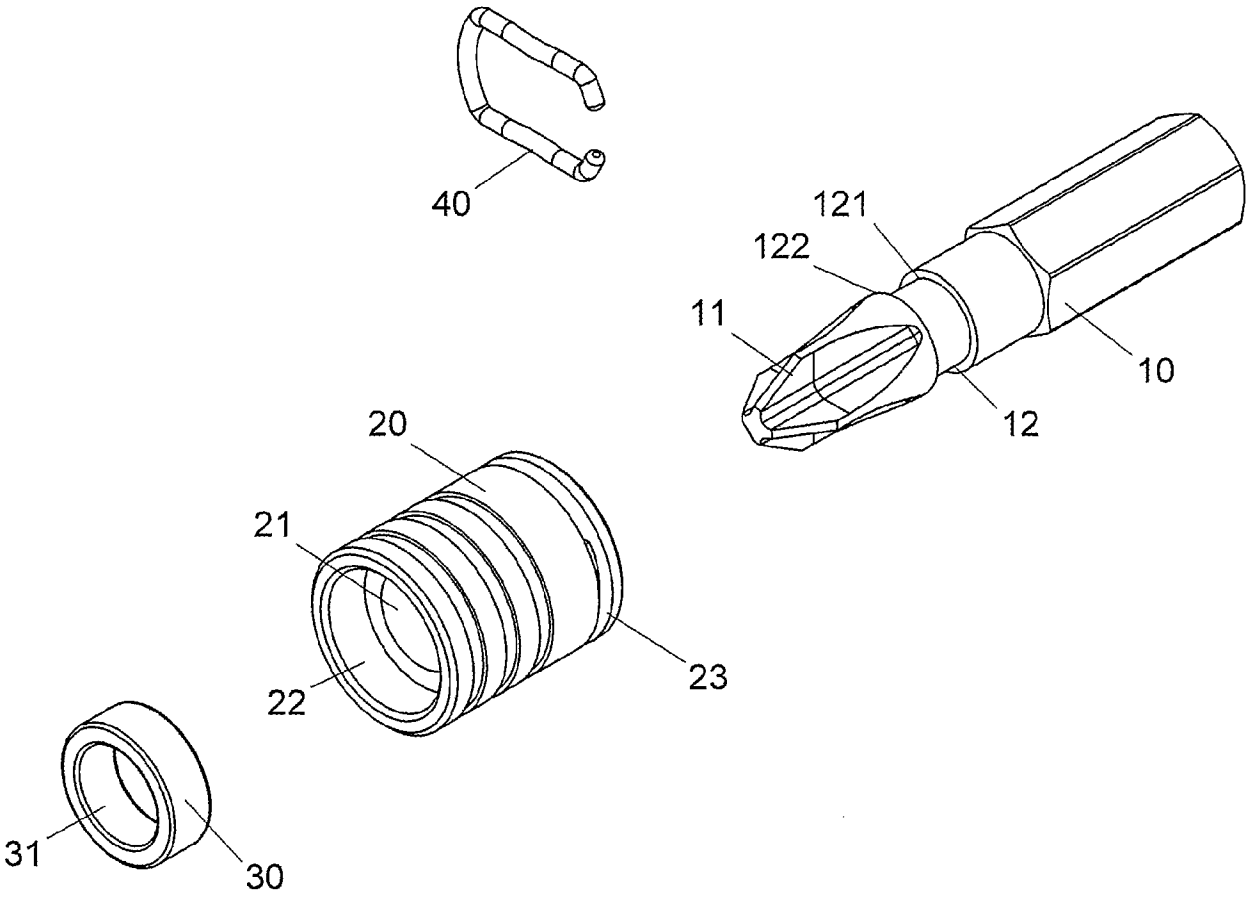
FIG. 11 is an exploded view of the second embodiment of the magnetic sleeve assembly of the present invention.
Figure 12:
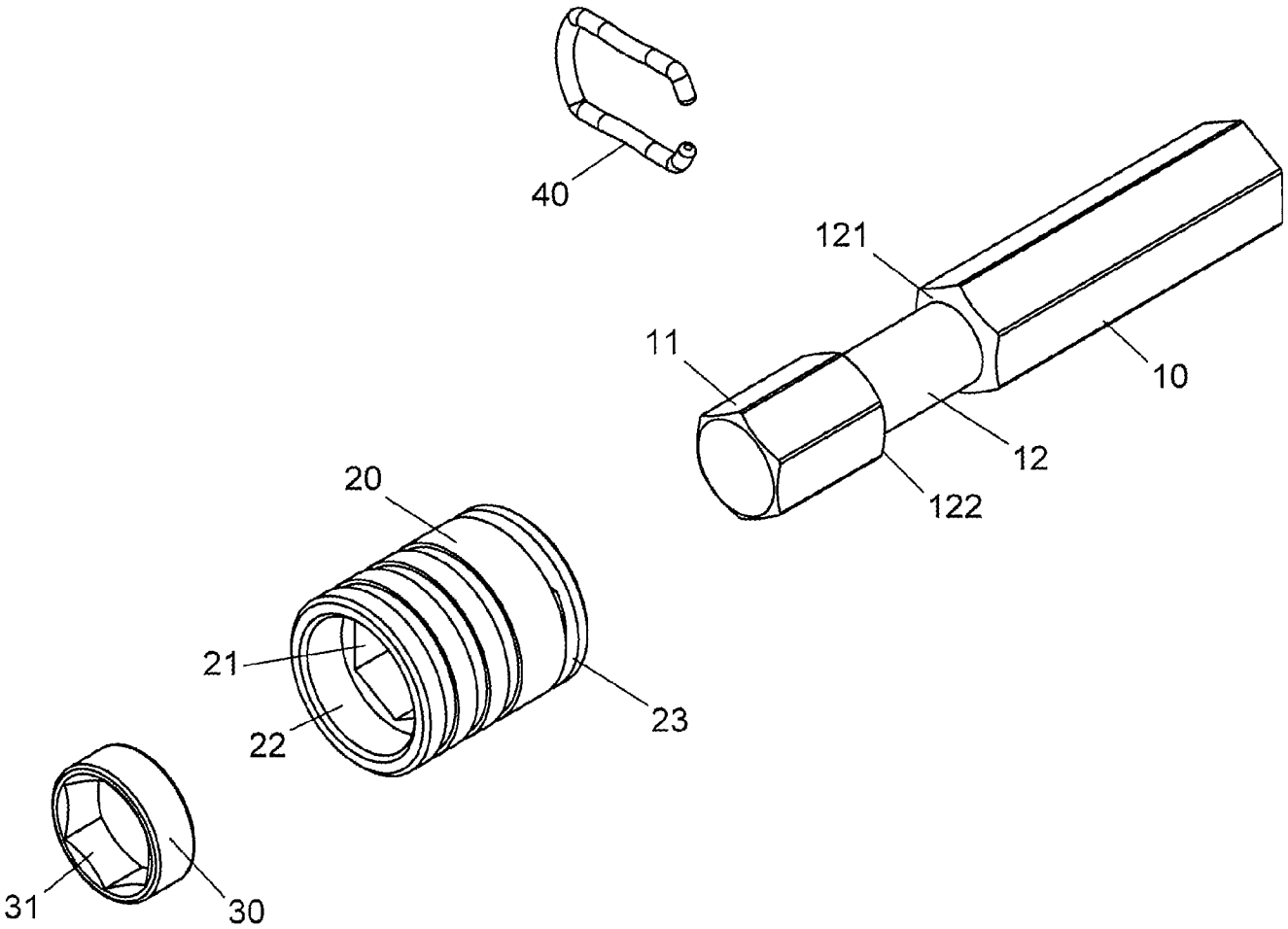
FIG. 12 is an exploded view of the third embodiment of the magnetic sleeve assembly of the present invention.

As shown in FIGS. 11 and 12, the body 10 is a screwdriver bit and a hexagonal wrench.

Figure 15:
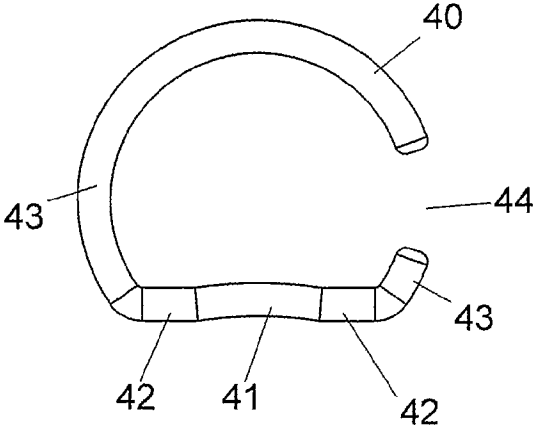
FIG. 15 is an end view of the C-clip of the fourth embodiment of the present invention.
Figure 14:
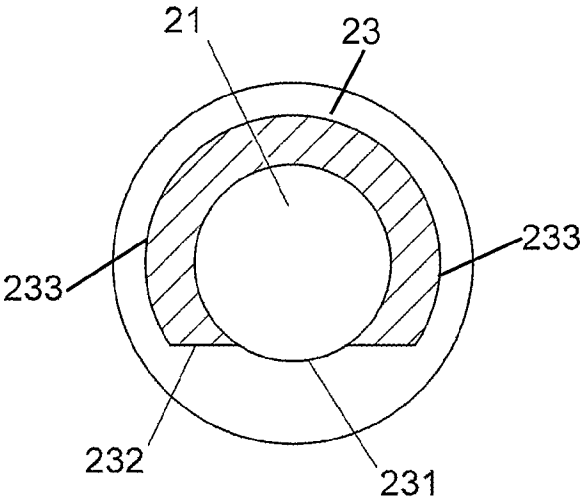
FIG. 14 is a cross sectional view, taken along line A-A in FIG. 13.
Figure 13:
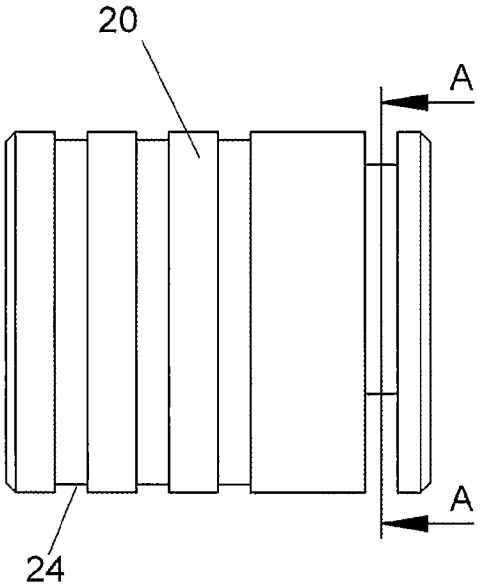
FIG. 13 is a side cross sectional view of the sleeve of the fourth embodiment of the present invention.

FIGS. 13 to 15 show that the sleeve 20 has only one through hole 231, and the C-clip 40 has only one engaging portion 41, and the C-clip is a D-shaped clip.

Figure 16:
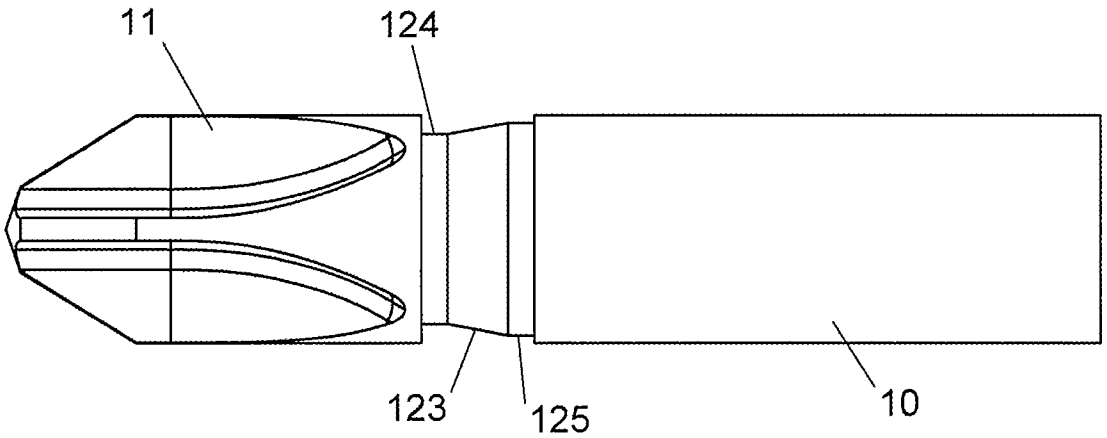
FIG. 16 is a side view the body of the fifth embodiment of the present invention.

As shown in FIG. 16, the first groove 12 of the body 10 includes an inclined annular face 123 which is connected between a first face 124 and a second face 125. Each of the first and second faces 124, 125 has an even diameter. The first face 124 is located close to the function 11. The diameter of the second face 125 is larger than the diameter of the first face 124 and is smaller than the diameter of the body 10.

Figure 17:
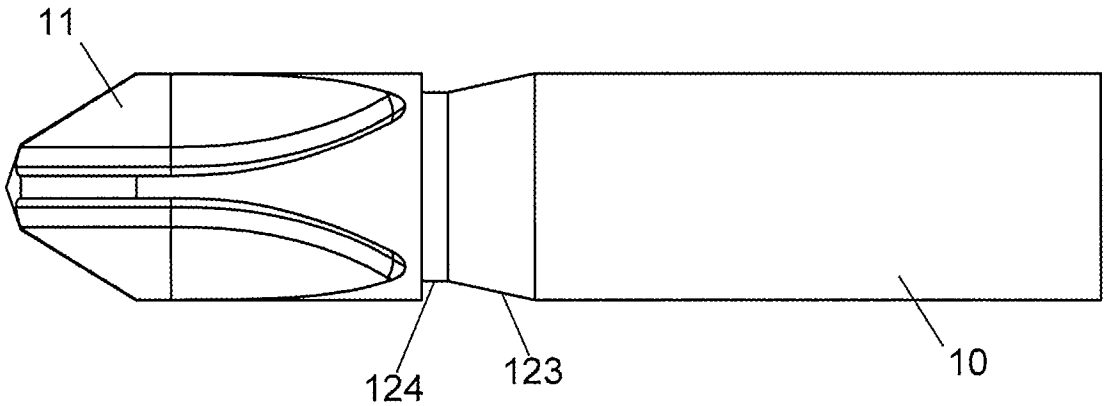
FIG. 17 is a side view the body of the sixth embodiment of the present invention.

As shown in FIG. 17, the first groove 12 of the body 10 includes an inclined annular face 123 which is connected between a first face 124 and a second face 125. Each of the first and second faces 124, 125 has an even diameter. The diameter of the second face 125 is larger than the diameter of the first face 124 and is the same as the diameter of the body 10. When the body 10 is to be inserted into a deep hole to reach an object 50 in the hole, and the outer diameter of the sleeve 20 is larger than an inner diameter of the hole. The sleeve 20 is slidably mounted to the body 10 without being restricted by the first sidewall 121, the body 10 is able to reach the object 50 in the hole.

The present invention has the following advantages:

The C-clip 40 is engaged with the second groove 23 of the sleeve 20 when the sleeve 20 is mounted to the body 10, the engaging portions 41 are engaged with the first groove 12 so that the assembly of the sleeve 20 and the C-clip 40 is quick.

The length of the groove 12 of the body 1 is designed to cooperate with the C-clip 40, the first groove 12 allows the sleeve 20 and the C-clip 40 to move a pre-set distance in the first groove 12. The C-clip 40 is restricted to be engaged with the body 10 and does not drop off.

As shown in FIGS. 9 and 10, the magnetic member 30 attracts the object 50 and the magnetic member 30 is movable to connect the function end 11 to the object 50 or to separate the function end 11 from the object 50. As shown in FIG. 10, when the object 50 is removed from the hole, it is attracted by the magnetic member 30 and does not drop.

The C-clip 40 has a certain level of flexibility to mount the sleeve 20 to the body 10. When the sleeve 20 is to be removed from the body 10, the user pulls the hooks 43 away from each other from the opening 44 of the C-clip 40, the C-clip 40 is then removed from the second groove 23, and then the sleeve 20 can be separated from the body 10. It is easy to remove the sleeve 20 and the C-clip 40. When the sleeve 20 is larger than the hole, and the body 10 is to be connected to the object 50 in the hole, the sleeve 20 can be removed from the body 10, and the body 10 can be inserted into the hole and reaches the object 50.

The annular recesses 24 in the outside of the sleeve 20 are designed to allow the user to grasp the sleeve 20 firmly and easily.

While we have shown and described the embodiment in accordance with the present invention, it should be clear to those skilled in the art that further embodiments may be made without departing from the scope of the present invention.

What is claimed is:

1. A magnetic sleeve assembly comprising:

a body having a function end formed on a first end thereof, a first groove defined in an outside of the body and located close to the function end, the first groove having a first sidewall and a second sidewall;

a sleeve having a first passage defined axially therethrough, the body extending through the first passage and the sleeve being rotatable relative to the body, a first space defined in a first end of the sleeve and communicating with the first passage, a diameter of the first space being larger than that of the first passage, a second groove defined in an outside of the sleeve and located close to a second end of the sleeve, at least one through hole defined in an inner end of the second groove and communicating with the first passage, the at least one through hole located between two third sidewalls which are located at the inner end of the second groove;

a magnetic member being a ring-shaped member and having a second passage defined axially therethrough, the magnetic member received in the first space, the second passage communicating with the first passage, and a C-clip being a flexible clip and engaged with the second groove of the sleeve, when the body extends through the sleeve, at least one engaging portion of the C-clip extends through the at least one through hole and is engaged with the first groove, a width of the at least one engaging portion is smaller than that of the first groove so that the at least one engaging portion is movable between the first and second sidewalls.

2. The magnetic sleeve assembly as claimed in claim 1, wherein the C-clip has two engaging portions which are located corresponding to each other, the second groove has two through holes, the two engaging portions extend through the two through holes and are engaged with the first groove.

3. The magnetic sleeve assembly as claimed in claim 1, wherein the two third sidewalls are two flat surfaces, each of the at least one engaging portion is connected between two contact portions which contact the two third sidewalls.

4. The magnetic sleeve assembly as claimed in claim 3, wherein the two third sidewalls are parallel with an axis of the sleeve.

5. The magnetic sleeve assembly as claimed in claim 1, wherein the C-clip has two hooks which are bent toward each other, the two hooks contact the inner end of the second groove.

6. The magnetic sleeve assembly as claimed in claim 1, wherein the body is a screwdriver bit.

7. The magnetic sleeve assembly as claimed in claim 1, wherein the body is a hexagonal wrench.

8. The magnetic sleeve assembly as claimed in claim 1, wherein the first groove of the body includes an inclined annular face which is connected between a first face and a second face, each of the first and second faces has an even diameter, the first face is located close to the function, the diameter of the second face is larger than the diameter of the first face and is smaller than a diameter of the body.

9. The magnetic sleeve assembly as claimed in claim 1, wherein the first groove of the body includes an inclined annular face which is connected between a first face and a second face, each of the first and second faces has an even diameter, the diameter of the second face is larger than the diameter of the first face and is the same as a diameter of the body, when the body is adapted to be inserted into a hole to reach an object in the hole, and an outer diameter of the sleeve is adapted to be larger than an inner diameter of the hole, the sleeve is slidably mounted to the body without being restricted by the first sidewall, the body is capable of reaching the object in the hole, the sleeve has multiple annular recesses defined in the outside thereof.

* * * * *